US006478575B2

(12) United States Patent
Sher

(10) Patent No.: US 6,478,575 B2
(45) Date of Patent: Nov. 12, 2002

(54) LIGHTER

(75) Inventor: Tak Chi Sher, Hong Kong (HK)

(73) Assignee: Polycity Enterprise Limited, Quarry Bay (HK)

( * ) Notice: Subject to any disclaimer, the term of this patent is extended or adjusted under 35 U.S.C. 154(b) by 53 days.

(21) Appl. No.: 09/780,445

(22) Filed: Feb. 12, 2001

(65) Prior Publication Data

US 2002/0110768 A1 Aug. 15, 2002

(51) Int. Cl.[7] ..... F23D 11/36; F23Q 2/28

(52) U.S. Cl. ..... 431/153; 431/255; 431/130; 431/132; 431/150; 431/152

(58) Field of Search ..... 431/153, 255, 431/132, 130, 129, 150, 146, 144, 152

(56) References Cited

U.S. PATENT DOCUMENTS 4,487,570 A * 12/1984 Lowenthal ..... 431/130
5,308,240 A * 5/1994 Lowenthal ..... 431/132
5,310,336 A * 5/1994 Segawa ..... 431/132
D360,051 S * 7/1995 Segawa ..... D27/155
5,460,521 A * 10/1995 Tsai ..... 431/153
5,496,169 A * 3/1996 Chen ..... 431/153
5,531,591 A * 7/1996 Yamazaki ..... 431/153
5,531,592 A * 7/1996 Tasi ..... 431/255

FOREIGN PATENT DOCUMENTS

GB 2 247 308 A * 3/1992
JP 6-201126 A * 7/1994

* cited by examiner

*Primary Examiner*—Henry Bennett
*Assistant Examiner*—Josiah C. Cocks
(74) *Attorney, Agent, or Firm*—Nath & Associates PLLC; Harold L. Novick

(57) ABSTRACT

The invention comprises a lighter which has a housing, a gas reservoir in the housing, and ignition means. The ignition means include a first manually moveable member and a second independently operable manually moveable member such that when the first member is operated gas is supplied from the gas reservoir and when the second member is operated the ignition means operates, so that both the first manually moveable member and the second manually moveable member must be operated to cause the lighter to ignite. The two manually moveable members may include a cap to the housing and a button moveable in a channel in the cap.

17 Claims, 8 Drawing Sheets

LIGHTER

BACKGROUND OF THE INVENTION

This invention relates to a lighter, particularly a small portable lighter of the type used to light cigarettes, cigars and other small combustible items.

With lighters presently available such as with the prior art lighter hereinafter described it is possible for children to cause the lighter to ignite by operating an ignition device by relatively simple manual manipulation. Such ignition could also occur accidentally when the lighter is contained in a pocket, handbag or similar container. It will of course be apparent that such a situation where the lighter can be ignited by children or accidentally is undesirable and dangerous.

OBJECT OF THE INVENTION

It is therefore an object of the present invention to provide a lighter that will obviate or minimise the foregoing disadvantages in a simple yet effective manner or which will at least provide the public with a useful choice.

STATEMENTS OF THE INVENTION

Accordingly the invention consists in a lighter including a housing, a gas reservoir in the housing, ignition means including a first manually moveable member and a second independently operable manually moveable member such that when the first member is operated gas is supplied from the gas reservoir and when the second member is operated the ignition means operates, so that both the first manually moveable member and the second manually moveable member must be operated to cause the lighter to ignite.

Preferably said first manually moveable member or said second manually moveable member comprises a cap and the other manually moveable member is slideable inwardly with respect to the cap and housing.

Preferably the second manually moveable member rotates about a pivot point within the housing and the first manually moveable member moves in an in and out motion within a channel in the second manually moveable member.

Preferably the second manually moveable member comprises an upper part and a lower part wherein the upper part is a cap and the lower part is a pivoted stem mounted in the housing.

Preferably the cap is hollow.

Preferably further including a lever which when operated by the first manually moveable member allows gas to be supplied to a nozzle and wherein biasing means are provided to bias the first manually moveable member to a position whereby the first manually moveable member does not contact the lever.

Preferably the biasing means comprise a spring.

Preferably the spring is a compression spring.

Preferably the stem mounts a pressure member which in use bears on the ignition means, the pressure member having an aperture therein through which a part of the first manually moveable member passes.

To those skilled in the art to which the invention relates, many changes in construction and widely differing embodiments and applications of the invention will suggest themselves without departing the scope of the invention as defined in the appended claims. The disclosures and the descriptions herein are purely illustrative and are not intended to be in any sense limiting.

BRIEF DESCRIPTION OF DRAWINGS

One preferred form of the invention will now be described with reference to the accompanying drawings in which.

FIG. 1 shows the prior art lighter in a closed unlit or "off" position and FIG. 2 shows the prior art lighter at the end of the striking action.

DESCRIPTION OF THE PREFERRED EMBODIMENT

Figure 1:
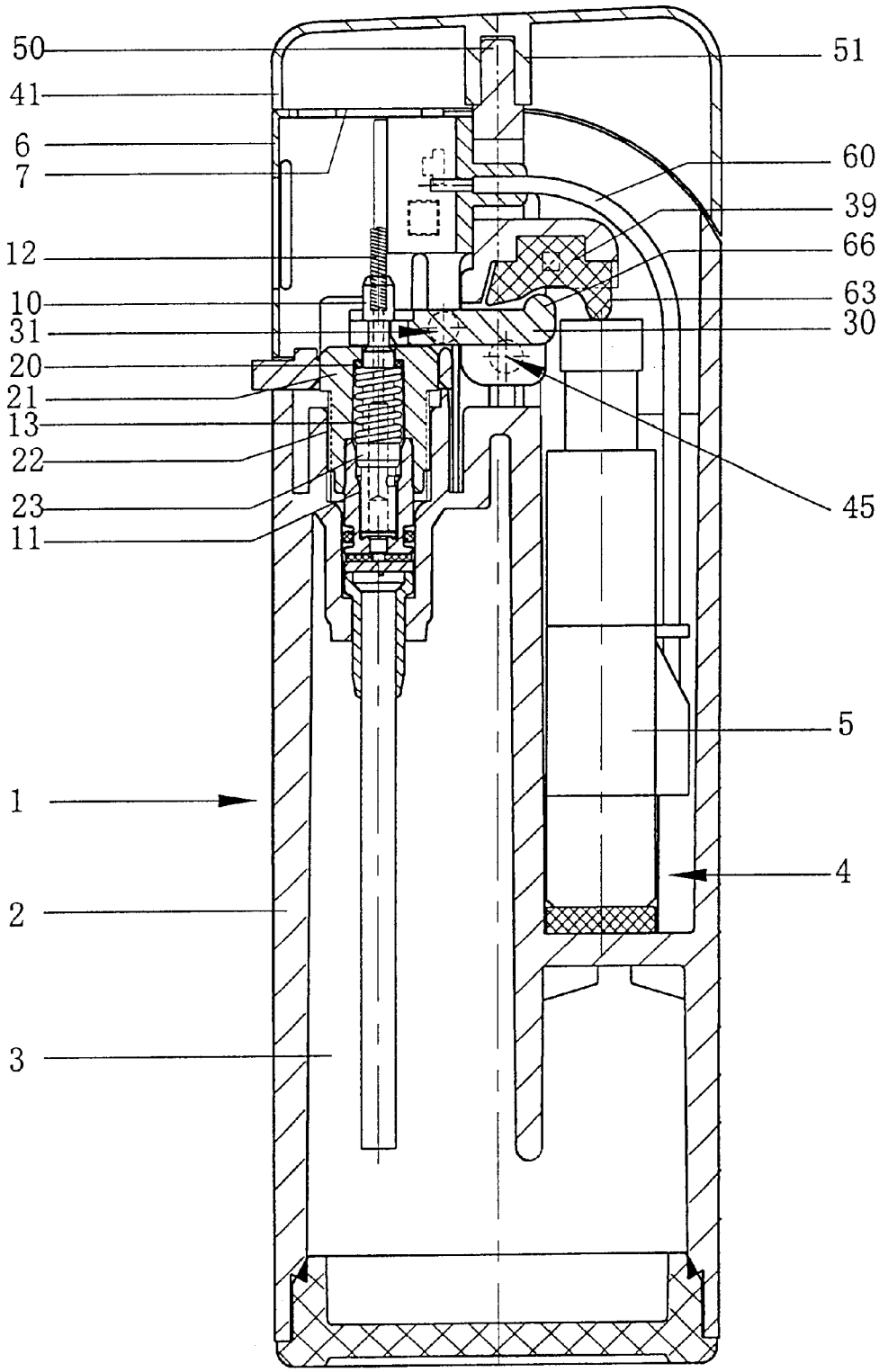
Fig. 1 (Prior Art)
FIGS. 1 and 2 are cross-sections of a prior art lighter.
Figure 2:
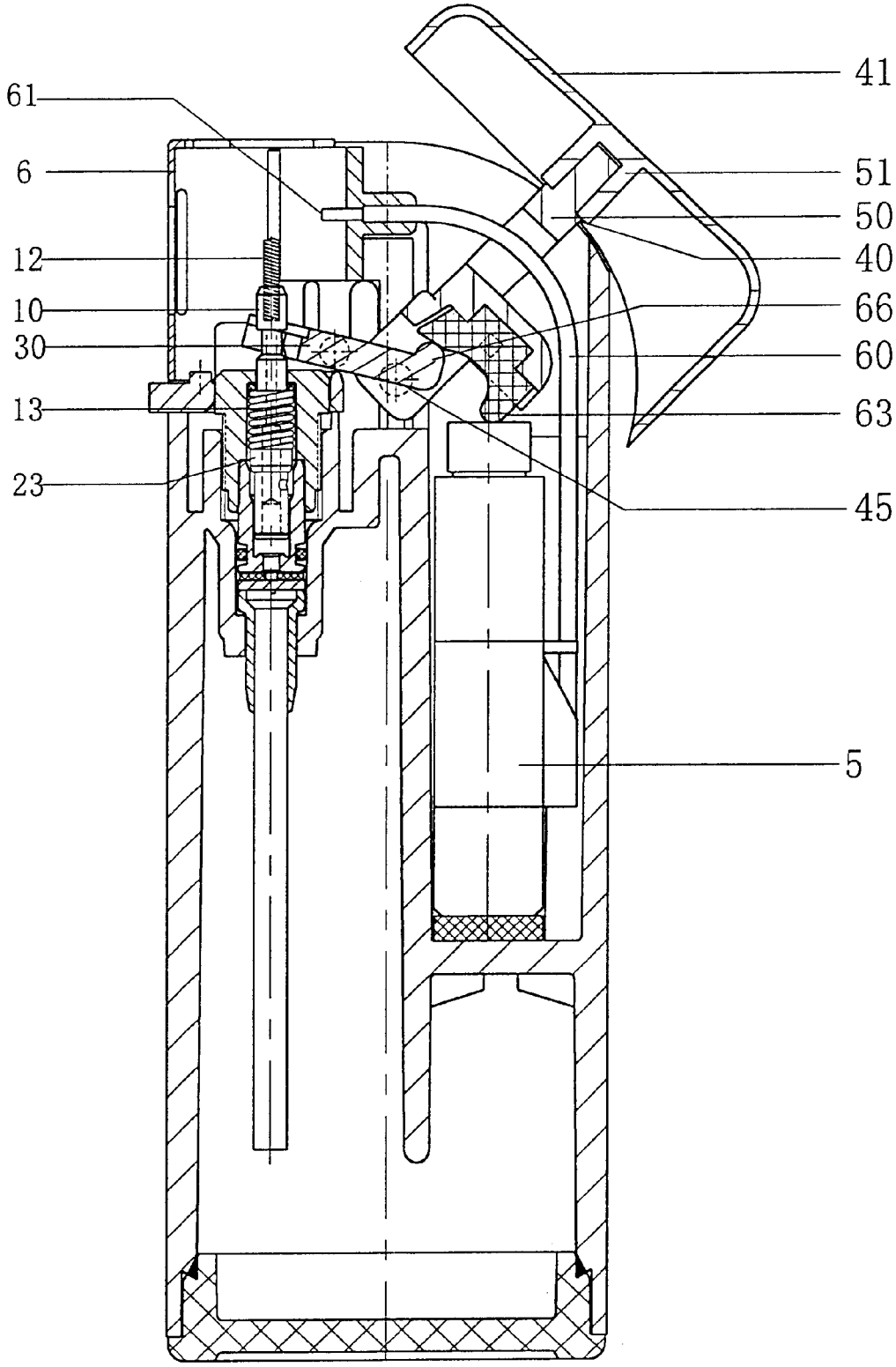
Fig. 2 (Prior Art)
Figure 3:
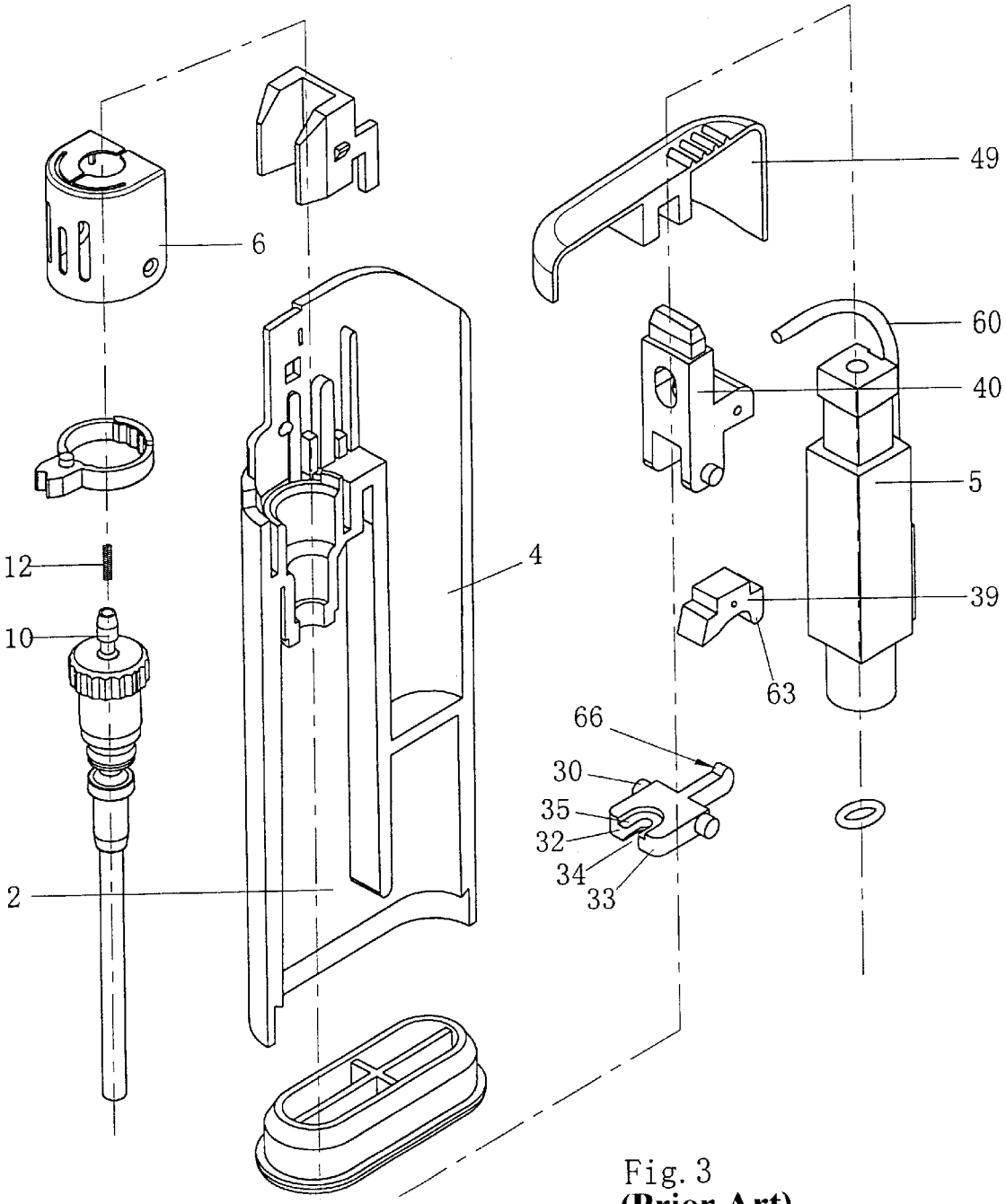
Fig. 3 (Prior Art)
FIG. 3 is a partial exploded view of parts of a lighter according to the prior art embodiment of FIGS. 1 and 2, FIGS. 4 and 5 are cross sectional views of a lighter in the "off" and the "ignited" position respectively in one preferred form of the present invention.

Referring to FIGS. 1, 2 and 3 the prior art lighter 1 comprises a housing 2 which provides a gas chamber 3 and a compartment 4 housing piezo electric unit 5. Above the tank 3 is provided a flame guard 6 with an aperture 7 therein. Gas nozzle 10 is mounted on hollow support 11 which receives gas from the gas chamber 3 in substantially the current known manner. The nozzle 10 which also is of substantially a known type carries a lighting spring 12. The nozzle 10, lighting spring 12, and support 11 are held in a withdrawn position by a biasing device such as spring 13 which is compressed between shoulders 20, provided in an apertured plug 21 which is fitted to an aperture 22 in the housing 2, and a collar 23 about the member 11.

The gas passageways are opened by lifting the member 11 and nozzle 10 to the position shown in FIG. 2 and this can be achieved by providing a lever 30 pivotally connected to the housing at 31. The lever 30 has a bifurcated end providing arms 32 and 33 which engage the nozzle 10. Between the arms is provided a space 34 having a wider recess 35 in which the nozzle 10 sits.

The opposite end 38 of lever 30 is engaged by a pressure member 39. The pressure member 39 is mounted on a downwardly depending stem 40 of a manually manipuable cap 41 which also covers the aperture 7 when the lighter is in the "off" position. The stem 40 is pivotally connected to the housing at 45 and the upper end of the stem 40 has a plug 50 which engages in a socket 51 forming the bottom part of the cap 41.

The Piezo electric unit 5 has a wire 60 which extends from the unit 5, the wire being positioned so that distal end 61 of wire 60, which provides are electrode, is positioned near the spring 12. The other electrode is provided by electrical contact between the piezo electric unit 60, the pressure unit 39, the lever arm 30, the nozzle 10 and the spring 12.

In use when the cap 41 is manipulated manually into the position shown in FIG. 2 pressure from a downwardly depending lug 63 on unit 39 causes the piezo electric unit 5 to operate whilst at the same time downward pressure on lug 66 of lever arm 38 raises the nozzle 10 and spring 12. The gas then flowing from the nozzle is ignited in substantially the known manner.

When the flame is no longer required the cap 41 returns to the position shown in FIG. 1 shutting off the gas flow and releasing pressure on the piezo electrode unit 5. The return of the cap 41 is effected by a biasing device such as a spring which in the preferred form, forms part of the piezo electric unit 5.

Figure 4:
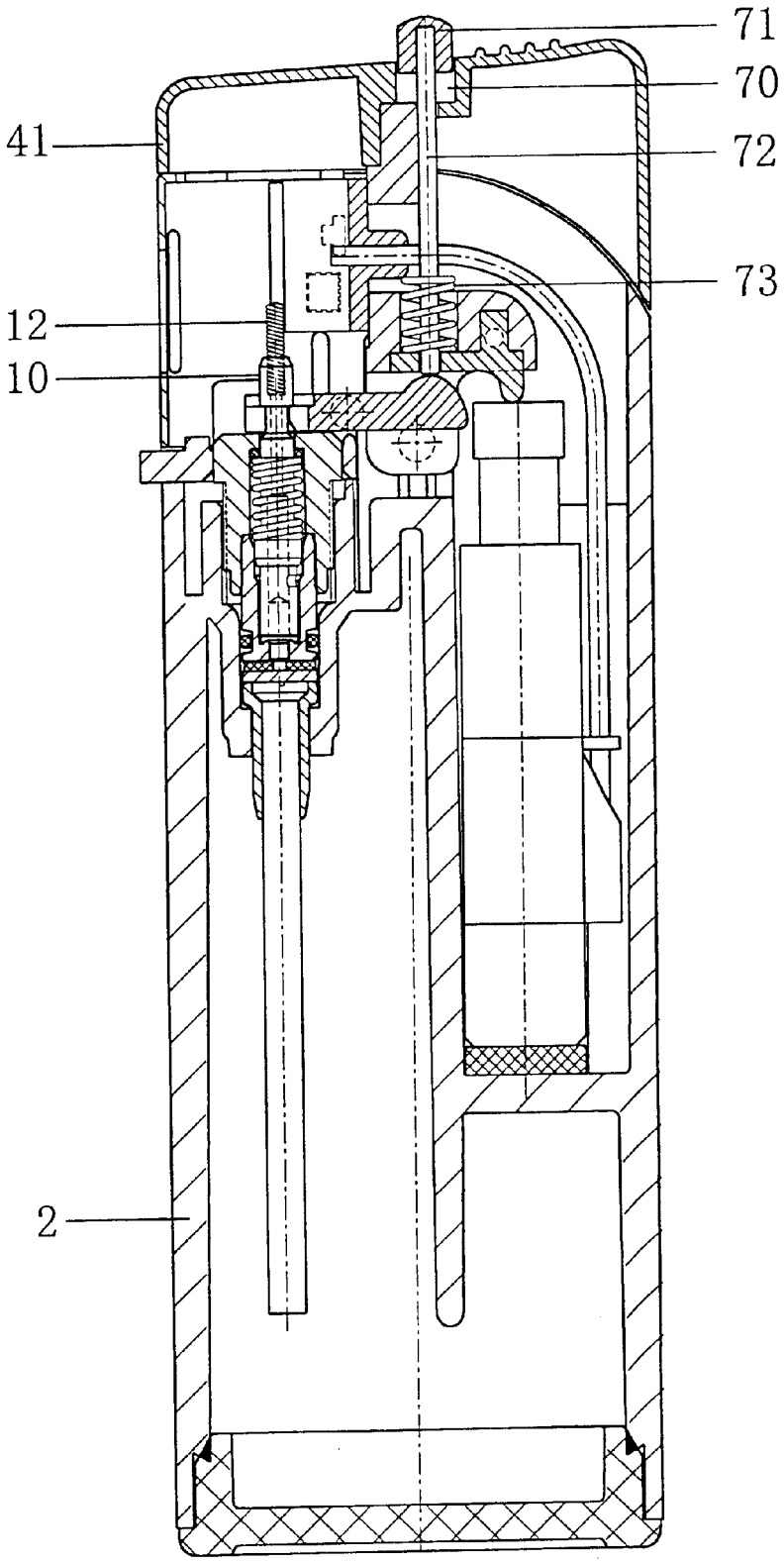
Figure 5:
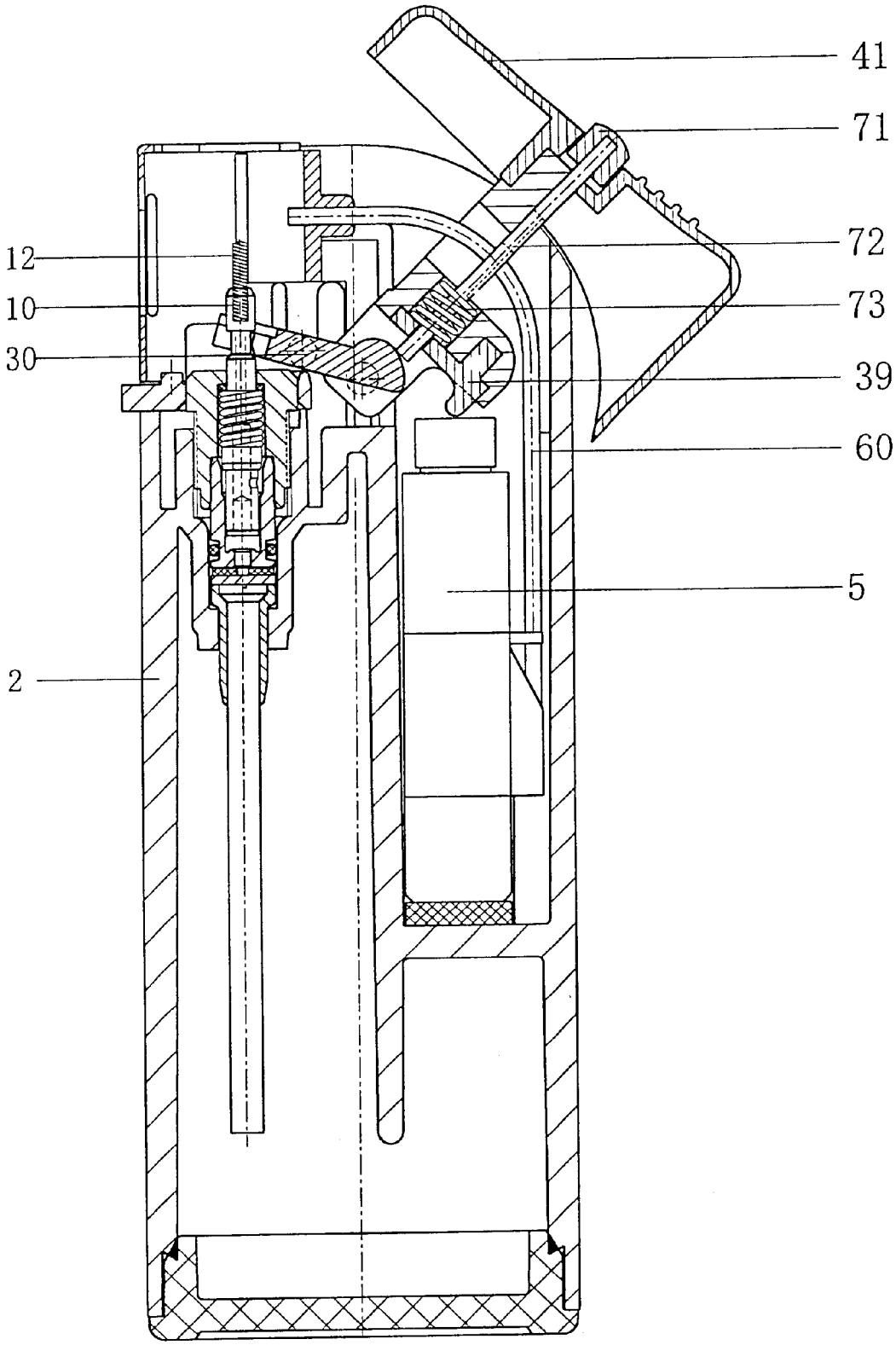
Figure 6:
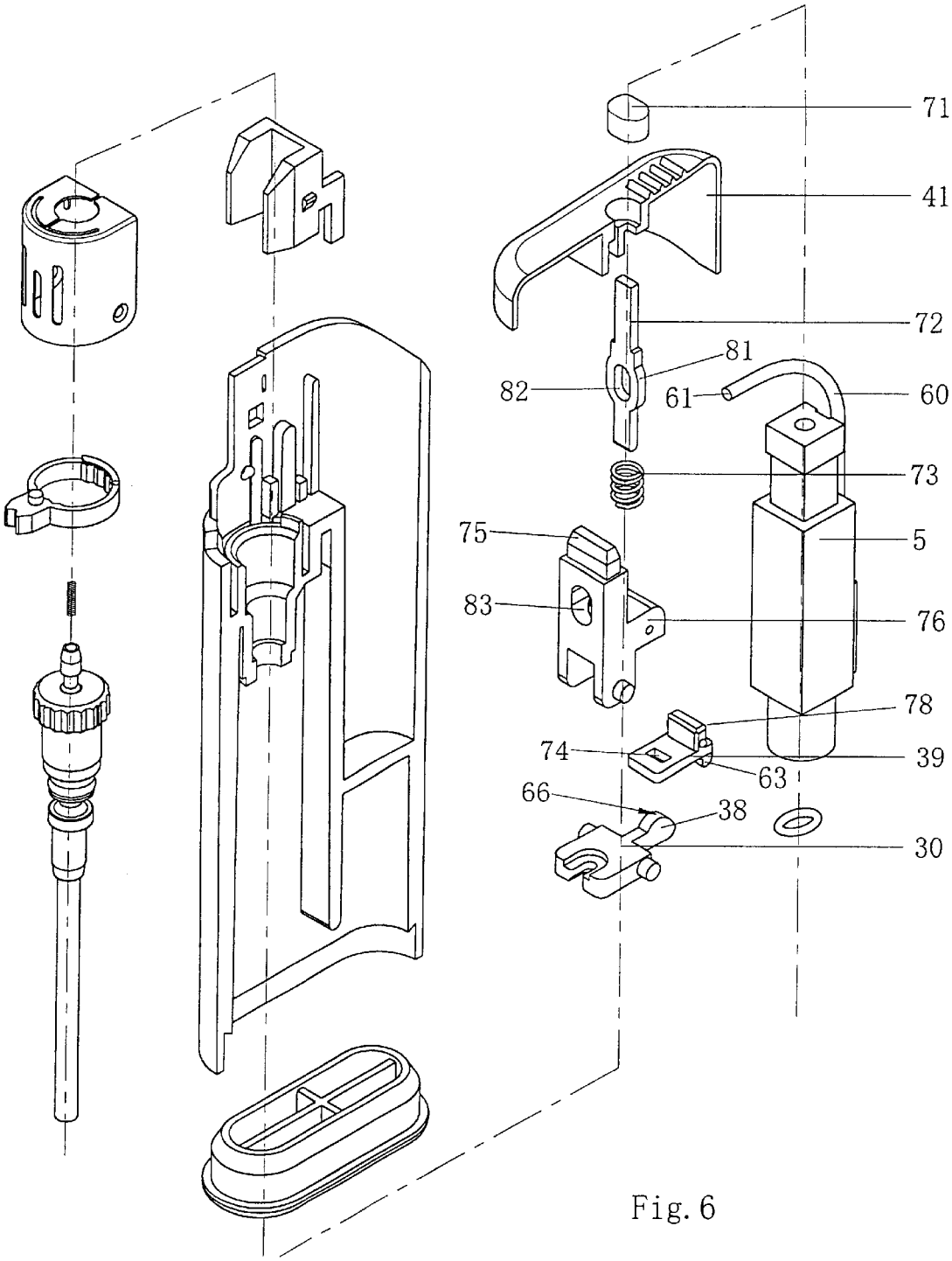
FIG. 6 is a perspective partially cut away view of a lighter.
Figure 8:
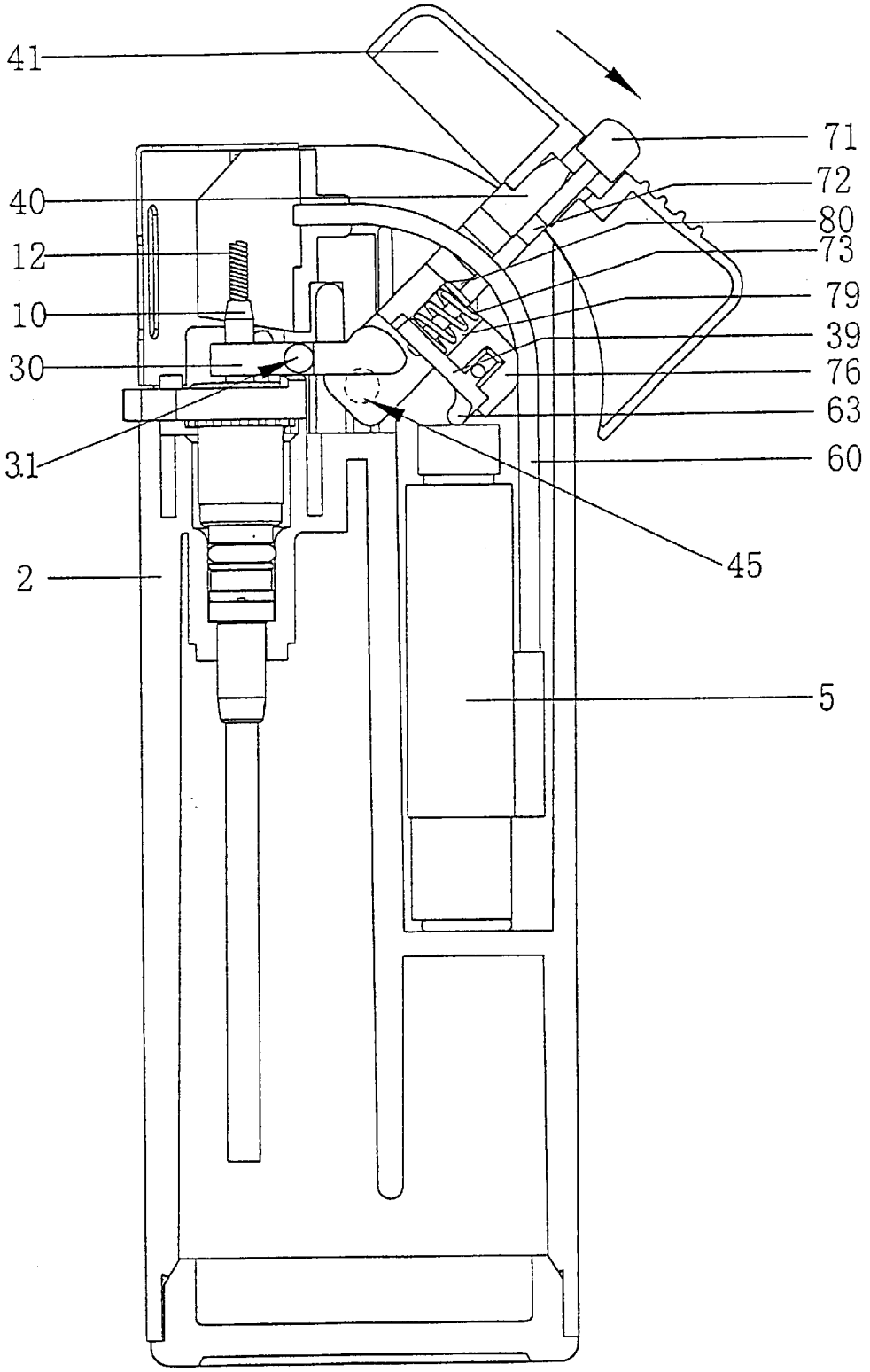
FIG. 8 is a cross sectional view of a lighter in the non-ignited position with only one of the operating movements activated according to the preferred form of the invention.

Referring now to FIGS. 4 and 8, the construction is similar except where modified as herein described.

When compared to the prior art lighter three components are added, in particular press button 71, lever 72 and spring 73 are added. The components comprising cap 41, stem 40, pressure unit 39, and lever 30 are also modified when compared to the prior art lighter of FIGS. 1 to 3.

An aperture 70 is provided in the central part of cap 41 to receive the press button 71. The top end of lever 72 is fixed to the press button 71. The other end of lever 72 passes through spring 73 and a positioning slot 74 in modified pressure unit 39 and is positioned by the slot 74. Pressure unit 39 is mounted underneath stem 40. The stem 40 has an outwardly extending lobe 76 having a slot 77 in the underside thereof. Rib 78 on the unit 39 engages in the slot 77. The upper part 75 of stem 40 is connected to cap 41. Under the action of spring 73, press button 71 and lever 72 can move up and down (ie. along the longitudinal axis of lever 72) within a distance allowed by spring 73. The lever 72 also passes through an aperture 79 in the lobe 76. The spring is held between pressure unit 39 and a recess 80 formed in stem 40 and a widened part 81 on the lever 72 which compresses the spring 73 when button 71 is pushed inwardly. Wire 60 passes through aperture 82 in lever 72 and aperture 83 in stem 40. When press button 71 is pressed inwardly, lever 72 moves inwardly also. The lower end of lever 72 presses against surface 66 of pressure unit 39 which causes lever 30 to rotate. This action will raise nozzle 10 to eject gas.

Figure 7:
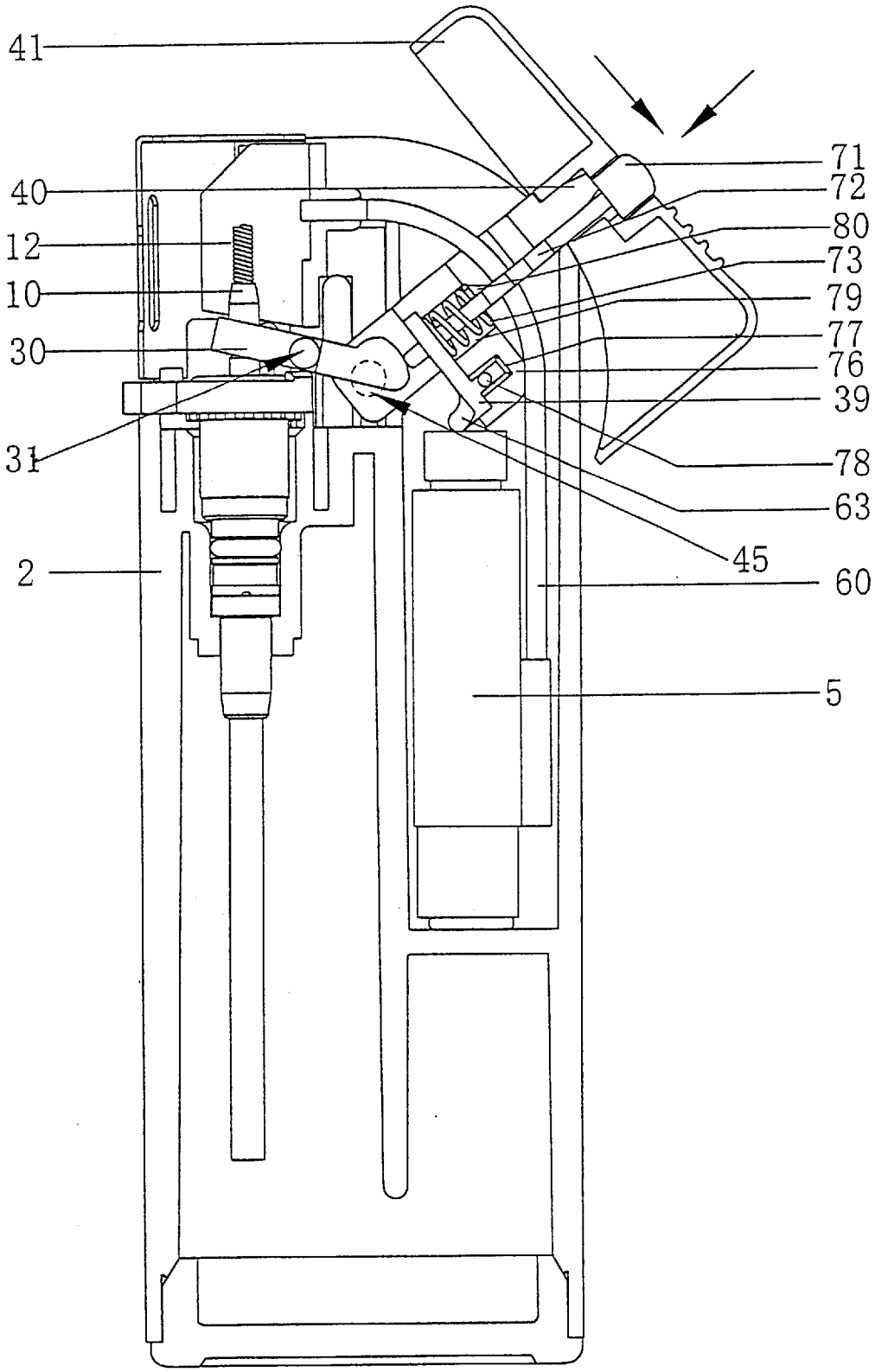
FIG. 7 is a cross sectional view of a lighter in the ignited position with both the operating movements activated according to the preferred form of the invention.

The operation of the lighter of the invention is shown in FIG. 7. The lighter is held by the hand with the thumb of the user, the user pressing button 71 inwardly. The inward movement of lever 72 causes lever 30 to raise nozzle 10 and gas is provided to the nozzle 10. While press button 71 is being pressed downward, the thumb also pushes cap 41 rearwardly so that stem 40 rotates. The pressure unit 39 will at the same time press against Piezo electric unit 5. Once the cap 41 reaches the necessary angle to strike the Piezo electric unit 5, electrons are emitted to create a potential difference. One electric pole will be transmitted from pressure unit 39 via lever 30, nozzle 10, and to the end of lighting spring 12. The other pole will be transmitted through wire end 61 to the end opening. The two poles will generate a spark and ignite the gas ejected from nozzle 10. A flame is therefore obtained. Unless the press button 71 is pressed inwardly, lever 30 cannot be rotated to raise nozzle 10 to eject gas. A flame cannot be obtained even when electrons are emitted by the Piezo electric unit. FIG. 8 shows the situation where the Piezo electric unit strikes but as the button 71 is not pressed no gas is provided to the nozzle.

Thus it can be seen that at least in the preferred form, the lighter of the invention is provided with safety features which will make it hard for children to use. It is believed that it would be difficult for children to complete both the continuous press down movement of the gas button while rotating the cap in a pulling movement to initiate the sparks thus providing a substantially child-proof lighter. It is also believed that it would be difficult for both of these movements to occur accidentally.

What is claimed is:

1. A lighter including:

a housing, a gas reservoir in the housing, ignition means including a first manually moveable member and a second independently operable manually moveable member, the second member being pivotably displaceable relative to said housing and the first member being linearly displaceable in a longitudinal direction relative to said second member, such that when the first member is operated gas is supplied from the gas reservoir and when the second member is operated the ignition means operates, and wherein both the first manually moveable member and the second manually moveable member must be operated to cause the lighter to light.

2. A lighter as claimed in claim 1 wherein one of said first manually moveable member or said second manually moveable member comprises a cap and the other manually moveable member is slideable inwardly with respect to the cap and housing.

3. A lighter as claimed in claim 1, wherein the second manually moveable member rotates about a pivot point within the housing and the first manually moveable member moves in an in and out motion within a channel in the second manually moveable member.

4. A lighter as claimed in claim 3 wherein the second manually moveable member comprises an upper part and a lower part wherein the upper part is a cap and the lower part is a pivoted stem mounted in the housing.

5. A lighter as claimed in claim 4, wherein the cap is hollow.

6. A lighter as claimed in claim 1 further including a lever which when rotated by the first manually moveable member allows gas to be supplied to a nozzle and wherein biasing means are provided to bias the first manually moveable member to a position whereby the first manually moveable member does not contact the lever.

7. A lighter as claimed in claim 6, wherein the biasing means comprise a spring.

8. A lighter as claimed in claim 7, wherein the spring is a compression spring.

9. A lighter as claimed in claim 4, wherein the stem mounts a pressure member which, in use, bears on the ignition means, the pressure member having an aperture therein through which a part of the first manually moveable member passes.

10. A lighter including:

a housing, a gas reservoir in the housing, ignition means including a first manually moveable member and a second independently operable manually moveable member such that when the first member is operated gas is supplied from the gas reservoir and when the second member is operated the ignition means operates;

wherein the second manually moveable member rotates about a pivot point within the housing and the first manually moveable member moves in an in and out motion within a channel in the second manually moveable member; and wherein both the first manually moveable member and the second manually moveable member must be operated to cause the lighter to light.

11. A lighter as claimed in claim 10 wherein one of said first manually moveable member or said second manually movable member comprises a cap and the other manually movable member is slideable inwardly with respect to the cap and housing.

12. A lighter as claimed as claimed in claim 10 wherein the second manually movable member comprises an upper part and a lower part wherein the upper part is a cap and the lower part is a pivoted stem mounted in the housing.

13. A lighter as claimed in claim 12, wherein the cap is hollow.

14. A lighter as claimed in claim 10 further including a lever which when rotated by the first manually moveable member allows gas to be supplied to a nozzle and wherein biasing means are provided to bias the first manually moveable member to a position whereby the first manually moveable member does not contact the lever.

15. A lighter as claimed in claim 14, wherein the biasing means comprise a spring.

16. A lighter as claimed in claim 15, wherein the spring is a compression spring.

17. A lighter as claimed in claim 12, wherein the stem mounts a pressure member which, in use, bears on the ignition means, the pressure member having an aperture therein through which a part of the first manually moveable member passes.

* * * * *